US008920663B2

(12) United States Patent
Keller

(10) Patent No.: US 8,920,663 B2
(45) Date of Patent: Dec. 30, 2014

(54) PRODUCTION OF A SECURITY ELEMENT PROVIDED WITH COLORED MICRO-DEPRESSIONS

(75) Inventor: Mario Keller, Seebruck (DE)

(73) Assignee: Giesecke & Devrient GmbH, Munich (DE)

( * ) Notice: Subject to any disclaimer, the term of this patent is extended or adjusted under 35 U.S.C. 154(b) by 189 days.

(21) Appl. No.: 13/509,071

(22) PCT Filed: Nov. 4, 2010

(86) PCT No.: PCT/EP2010/006730

§ 371 (c)(1),
(2), (4) Date: May 10, 2012

(87) PCT Pub. No.: WO2011/057739

PCT Pub. Date: May 19, 2011

(65) Prior Publication Data

US 2012/0223050 A1 Sep. 6, 2012

(30) Foreign Application Priority Data

Nov. 11, 2009 (DE) ..... 10 2009 052 538

(51) Int. Cl.
*B44C 1/22* (2006.01)
*B42D 25/00* (2014.01)
*B42D 15/00* (2006.01)

(52) U.S. Cl.
CPC ..... *B42D 15/105* (2013.01); *B42D 2035/22* (2013.01); *B42D 2031/16* (2013.01); *B42D 2035/24* (2013.01); *B42D 2035/44* (2013.01); *B42D 2033/10* (2013.01); *B42D 2031/14* (2013.01); *B42D 2035/28* (2013.01); *B42D 2033/20* (2013.01); *B42D 2031/28* (2013.01); *B42D 15/0013* (2013.01)
USPC ..... 216/41; 216/43; 216/54; 101/115; 101/119; 101/128.4

(58) Field of Classification Search
USPC ..... 216/41, 43, 54; 101/115, 128.4, 119
See application file for complete search history.

(56) References Cited

U.S. PATENT DOCUMENTS 6,688,221 B1 * 2/2004 Kaule ..... 101/129
2008/0106091 A1 * 5/2008 Tompkin et al. ..... 283/91

(Continued)

FOREIGN PATENT DOCUMENTS

DE 102006037431 A1 4/2008
DE 102007055112 A1 7/2008

(Continued)

OTHER PUBLICATIONS

International Preliminary Report on Patentability in PCT/EP2010/006730, May 24, 2012.

(Continued)

*Primary Examiner* — Binh X Tran
(74) *Attorney, Agent, or Firm* — Workman Nydegger

(57) ABSTRACT

A method for producing a security element having microdepressions for security papers, with the microdepressions being colored with a certain color, involves the steps of (a) coating an upper side of a carrier with an embossable layer; (b1) forming microdepressions in the embossable layer to configure an embossed layer; (c) applying the certain color on the upper side, so that the color remains in the microdepressions; (b2) applying a structured protective layer on the coated upper side, wherein the structured protective layer does not cover the microdepressions that are to be colored with the certain color, after step (b1) and before step (c); and removing the structured protective layer and thereby a color toning after step (c).

20 Claims, 5 Drawing Sheets

(56) References Cited

U.S. PATENT DOCUMENTS

| | | | | |
|---|---|---|---|---|
| 2008/0284157 | A1* | 11/2008 | Muke et al. | 283/86 |
| 2009/0317595 | A1 | 12/2009 | Brehm et al. | |
| 2010/0037326 | A1 | 2/2010 | Batistatos et al. | |
| 2010/0290121 | A1* | 11/2010 | Schilling et al. | 359/576 |
| 2011/0018253 | A1* | 1/2011 | Birsztejn et al. | 283/81 |
| 2012/0031978 | A1* | 2/2012 | Hansen et al. | 235/488 |

FOREIGN PATENT DOCUMENTS

| | | | |
|---|---|---|---|
| DE | 102008029158 | A1 | 6/2009 |
| EP | 1520929 | A1 | 4/2005 |
| WO | 2008031170 | A1 | 3/2008 |

OTHER PUBLICATIONS

H. Kipphan, Handbook of Print Media, Technologies and Production Methods, 2000, p. 409, Springer Verlag, Berlin, DE.

International Search Report for PCT/EP2010/006730, Mar. 16, 2011.

International Preliminary Report on Patentability for PCT/EP2010/006730, May 15, 2012.

* cited by examiner

PRODUCTION OF A SECURITY ELEMENT PROVIDED WITH COLORED MICRO-DEPRESSIONS

BACKGROUND OF THE INVENTION

A. Field of the Invention

The invention relates to a method for producing a security element equipped with micro-depressions for security papers, documents of value or the like, with the micro-depressions being colored with a certain color and the method having the following steps: coating an upper side of a carrier with an embossable lacquer, forming micro-depressions in the lacquer in an area of the upper side coated with lacquer, and applying the certain color on the upper side and scraping off excess color, so that the color remains in the micro-depressions.

B. Related Art

Objects to be protected are frequently supplied with a security element allowing a verification of the authenticity of the object and at the same time serving as protection against unauthorized reproduction.

Objects to be protected are for example security papers, identity documents and documents of value (such as e.g. banknotes, chip cards, passports, identification cards, identity cards, shares, bonds, certificates, vouchers, checks, admission tickets, credit cards, health cards, . . . ) as well as product securing elements, such as e.g. labels, seals, packagings.

The falsification security and visibility of a security element is particularly great when the security element shows colored motifs or information.

DE 102007055112 A1 and DE 102008029158 A1 disclose the employment of a so-called washable ink for structuring a layer.

A security element known for banknotes is the so-called security thread and the so-called security strip. This is, as a rule, a strip of a width of 0.8 to 2 mm that is incorporated into the paper upon the production of banknotes or woven in as window security thread in such a fashion that it is partly disposed openly or that is glued on the paper. For additional protection against copying this element is mostly equipped with optical properties. The combination of microstructure elements with micro lenses disposed above them, enlarging the microstructure elements, has proven to be particularly falsification-proof. Here in particular the so-called moiré effect can be used. Such security elements are also referred to as "moiré magnifiers". An exemplary description of such a security element can be found in WO 2008/031170 A1, suggesting to produce the micro lenses and microstructures using an embossable lacquer.

It has turned out that colored structures ensure even further falsification protection in particular when moiré magnifiers are used. It would therefore be conceivable to color the microstructure elements of moiré-magnifier security elements. However, doing so, the problem would arise that normally color residues remain also outside the microstructure elements as so-called toning, thereby reducing the difference in contrast between the microstructure elements filled with color that are usually configured as depressions and the rest of the surface.

SUMMARY OF THE DISCLOSURE

It is the object of the invention to specify a method for producing a security element provided with microdepressions colored with a certain color, for security papers, documents of value or the like, in which security element the colored microdepressions have a high color contrast to the surroundings.

This object is achieved according to the invention by a method for producing a security element for security papers, documents of value or the like that is equipped with micro-depressions, with the micro-depressions being colored with a certain color and the method having the following steps:

a) Coating an upper side of a carrier with an embossable layer, b1) forming micro-depressions in the embossable layer to configure an embossed layer, b2) applying a structured protective layer on the coated upper side, with the structured protective layer not covering the micro-depressions in the layer that are to be colored with the certain color, c) applying the certain color on the upper side, so that the color remains in the micro-depressions, and d) removing the structured protective layer and thereby a color toning present outside the micro-depression.

The invention achieves a partial coloring of micro-depressions without there remaining a disturbing color toning outside the micro-depressions.

For this it is essential that a protective layer is present in the areas in which no micro-depressions are to be colored with the certain color at the time of color application. When this protective layer is removed after the coloring, at the same time a color toning, i.e. color residues outside the micro-depressions to be colored, that is otherwise inevitable when color is applied, is removed. Thus the color filling is limited to the micro-depressions that are to be colored with the certain color. The consequence is a good contrast.

This contrast is advantageous particularly when the microdepressions are used in connection with a moiré-magnifier security element, since the optical effect of the latter is impaired particularly strongly by toning shadows outside the microdepressions. However, when the invention is described here in connection with moiré magnifiers, this is to be understood as merely exemplary. The method according to the invention can be applied in all variants also regarding any desired other colored micro-depressions, with "micro-depressions" being understood as depressions that, relating to a process of color application and, if applicable, the removal of excess color, e.g. by scraping off, have a small depth, so that after the color application or, if applicable, the removal of excess color, the color remains in the depressions. Micro-depressions in the sense of this invention have a depth of in particular 1.5 to 3.5 μm, particularly preferably 2.0 to 3.0 μm.

The method according to the invention in particular simply permits to simultaneously form hologram structures in the layer that can be configured as embossing layer and in particular as lacquer, and in which the micro-depressions are formed. Then micro-depressions and hologram structures can be formed at the same time in one embossing process, which is of course advantageous in terms of production engineering. These hologram structures are metalized, if applicable. Subsequently they are protected suitably, so that the hologram structures are not colored. This protection can be achieved through the protective layer provided for preventing color toning.

A metalization of the coated surface is advantageous for embodiments in which hologram structures are applied, since a hologram structure usually has to be metalized. In a preferred further development it is therefore provided that also hologram structures are formed in the embossed layer, with these hologram structures being metalized and then equipped with the protective layer, and that outside the hologram structures the upper side is equipped with a protective coating and areas of the hologram structure not equipped with the protective coating are demetalized by means of etching.

For the desired improvement of contrast it can be sufficient that the protective layer leaves blank a window with the micro-depressions, without the elevations between the micro-depressions being covered with the protective layer.

Depending on the fineness, i.e. the spaces between the micro-depressions, it can also be required to leave blank exclusively the micro-depressions and to otherwise completely cover the upper side with the protective layer, i.e. also the elevations between the micro-depressions.

For this purpose for structuring the protective layer a separating coating can be provided in the micro-depressions themselves. This then makes it possible to apply a protective layer that is lifted off through removal of the separating layer only above the micro-depressions and thus covers all remaining areas. Then the structuring of the protective layer is such that exclusively the micro-depressions are left blank. Thus no color toning can remain on the elevations of the micro structuring either. This leads to a particularly high contrast.

The security element produced in this fashion can be further processed with usual methods; it is possible to provide for an adhesive layer or a primer print on the top or lower side of the carrier.

The color application on the surface can take place in a great variety of ways. It is thus possible, for color application to apply color over the surface of the upper side and then to remove, e.g. scrape off, excess color outside the micro-depressions. The color can also be applied from the start only in the areas in which micro-depressions (and consequently also elevations, particularly microelevations) are provided. For this purpose e.g. the so-called flexographic printing method or the kiss printing method comes into question, as mentioned in H. Kipphan (ed.), Handbuch der Printmedien, Springer Verlag, 2000, p. 409. The complete disclosure of this standard work of printing technology is included in its entirety in the present description regarding the kiss printing method.

It is an important advantage of the invention that the color application method no longer has to be optimized in view of applying the color preferably exclusively in the micro-depressions to be colored. The structured protective layer used in the method according to the invention automatically ensures that possible toning shadows that remain in a color-application method that is possibly insufficient from the points of view so far, are removed again. The invention consequently leads to a much larger variety of color-application methods than was possible in the state of the art. A corresponding cost reduction in production is the positive result.

For the protective layer it is essential that it securely adheres to the upper side during the color-application process and nevertheless can be removed without residue after the color application. For this purpose known protective lacquers or resist lacquers come into question. A washing procedure can also be used, as for example described in EP 1520929 A1 (with further references there). In this regard the disclosure of this publication is included in its entirety in this description.

The method according to the invention in this regard also allows to produce multicolor microstructures in that the corresponding steps b2) to d) are repeated for another, further color, with the protective layers in the individual runs being applied to different areas that preferably do not overlap in the area of the micro-depressions.

Obviously, the above-mentioned characteristics and the characteristics to be explained in the following can be employed not only in the stated combinations, but also in different combinations or on their own, without leaving the scope of the present invention.

DESCRIPTION OF THE DRAWINGS

In the following the invention is explained in more detail by way of example with reference to the accompanying figures that also disclose essential characteristics of the invention. The figures are described as follows.

DETAILED DESCRIPTION OF EXEMPLARY EMBODIMENTS

Figure 1:
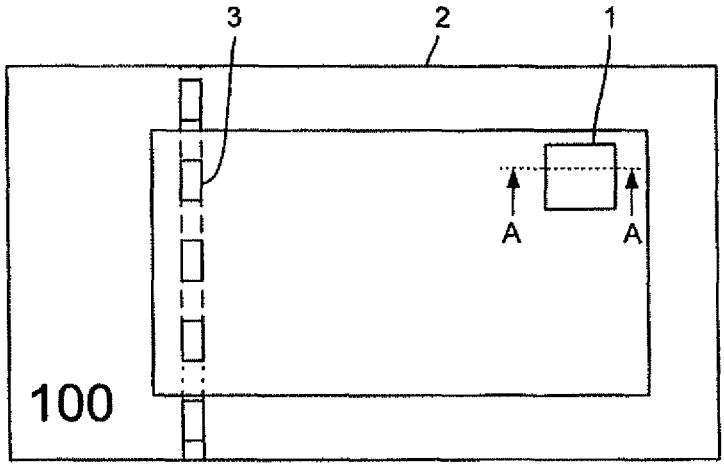
FIG. 1 a top view of a banknote with a security element 1.

For the sake of improved presentability, the figures are all represented not true to scale, in particular with reference to layer thicknesses. Further hatchings are omitted partly to be able to represent the structure of the corresponding security element 1 more clearly. Moreover, elements that are functionally and/or structurally equal or consistent bear the same respective reference numeral in all figures so as to prevent repetitions of the description. In the subsequent description of section positions the side that is disposed on top in the representations is referred to as front side of the security element. The back side is correspondingly the side disposed on the bottom. This convention merely serves to simplify the description and is not meant as a limitation regarding the structure and/or application of the security element.

In the embodiment shown in FIG. 1 a security element 1 is integrated in a banknote 2. The security element 1 provided on the banknote 2 can also form part of a security thread 3 of the banknote, that, as represented exemplarily in FIG. 1, is usually woven into the paper of the banknote 2 in such a fashion that it is visible partly on the front side (the side visible in FIG. 1) and partly on the back side of the banknote. It is also possible to arrange the security element 1 at least partly above a window provided in the banknote 2. However, these possibilities are of course only examples for the use of the subsequently described security element 1 that can of course also be used in a different fashion for copy protection or imitation protection of a protected object.

Figure 2:
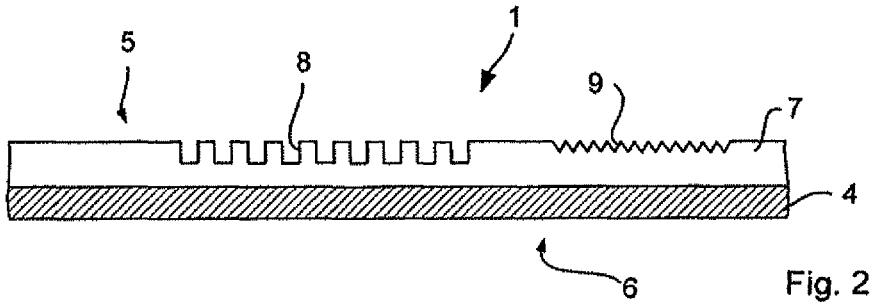
FIG. 2 to 10 sections through the security element 1 along the line A-A of FIG. 1, with the individual steps showing subsequent stages of a first variant of a production method up to the conclusion in FIG. 10, FIG. 11 to 17 sections through the security element 1 along the line A-A of FIG. 1, with the individual steps showing subsequent stages of a second variant of a production method up to the conclusion in FIG. 17.

FIG. 2 shows a sectional view through the security element 1 of FIG. 1 at the start of its production according to a first embodiment. For production a carrier 4 that can be configured as a foil for example, is equipped on its upper side 5 with an embossable layer which, in the described embodiment, is an embossing lacquer layer, for example a UV-curable embossing lacquer. Of course the coating can also be provided on a lower side 6 of the foil 4. However, this description, for reasons of simplicity, is limited to explaining the layer structure on the upper side 5.

In the embossing lacquer layer microstructure elements 8 and at least one hologram 9 are molded, for example through a known embossing method, as mentioned in WO 2008/031170 A1 mentioned at the outset. Consequently, an embossed layer 7 on the top side is obtained.

Figure 3:
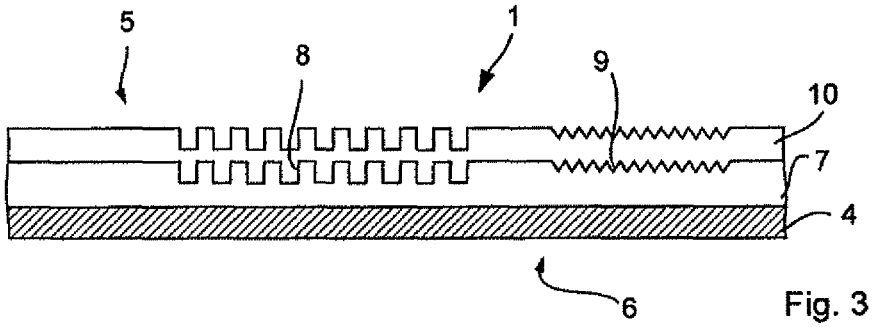

After the state represented in FIG. 2 is reached, a metalization of the complete surface takes place in that an aluminum layer 10 is applied, for example vapor-deposited. The application of the aluminum layer 10 takes place in such a fashion that the microstructure elements 8 as well as the hologram structure 9 on the upper side of the aluminum layer 10 are maintained. FIG. 3 represents this state. Of course an aluminum layer 10 is only an example for one of the many possible metalizations.

Figure 4:
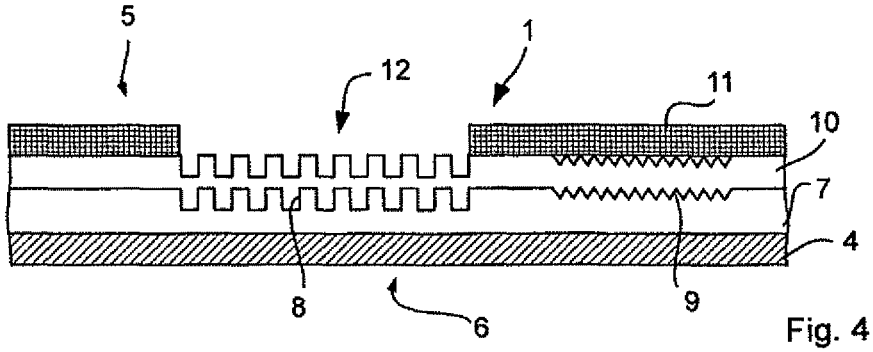

Now a protective lacquer 11 is applied on the areas which are not to be colored. The protective layer 11 thus leaves blank a window 12 above the microstructure 8. The protective lacquer can be a resist lacquer as known from printing technology or semiconductor technology. Such a resist lacquer is usually applied over the complete surface first and then photographically structured by means of a suitable exposure, so that after developing only the exposed (in the case of a positive lacquer) or the unexposed (in the case of a negative lacquer) areas remain blank. The fashion in which or how the protective lacquer 11 is applied is not really relevant for the invention. Thus e.g. also a washing ink can be employed. However, it is essential that the window 12 is created in the protective lacquer 11, leaving blank those areas of the microstructure element 8 that are to be colored. When the microstructure is to be equipped with different colors, one will not strive for the state represented in FIG. 4, in which the window 12 leaves the microstructure completely blank, but, in different runs for each color, will position the window 12 in such a fashion that the areas of the microstructure to be colored with the respective color remain blank and the areas not to be colored with the color are covered by the protective lacquer 11.

Figure 5:
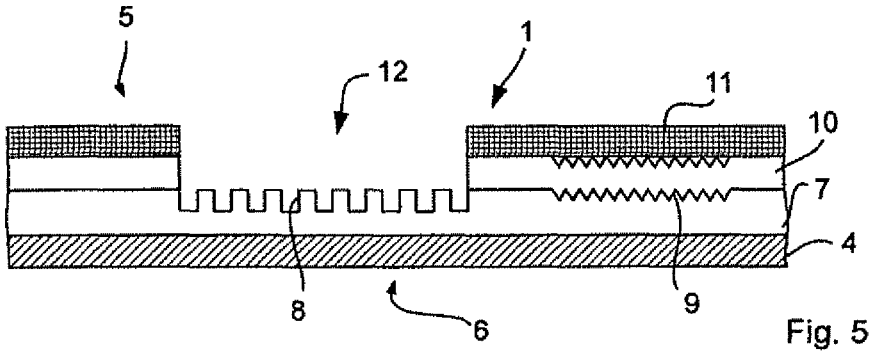

Next the aluminum layer 10 is removed in the area of the window 12 by means of an etching step, so that the microstructure in the embossing lacquer layer 7 is uncovered. This state is recognizable in FIG. 5.

Figure 6:
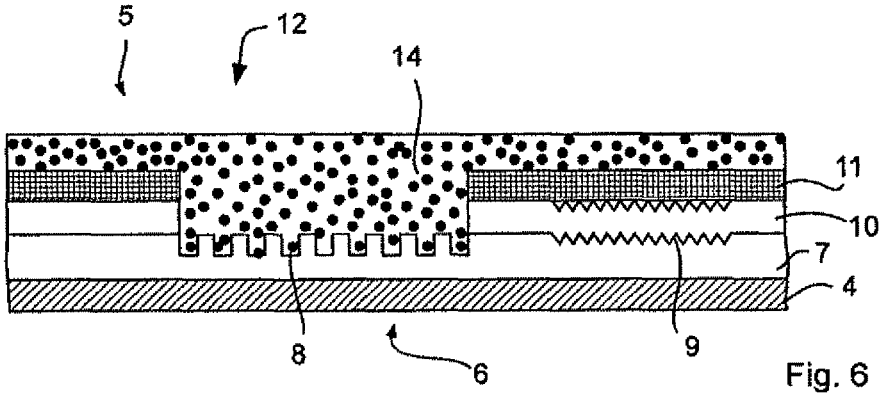

Subsequently, as shown in the sectional view of FIG. 6, a color layer 14 is applied over the complete surface. This is then removed again as far as possible. This takes place for example by scraping off, so that the color layer 15 remains, however which as a rule inevitably comprises a toning layer 16 also in those areas under which there are no microstructures 8 disposed. The result is the state according to FIG. 7. This can also be reached through a so-called kiss printing method that is an alternative to full-surface application and scraping off.

Figure 7:
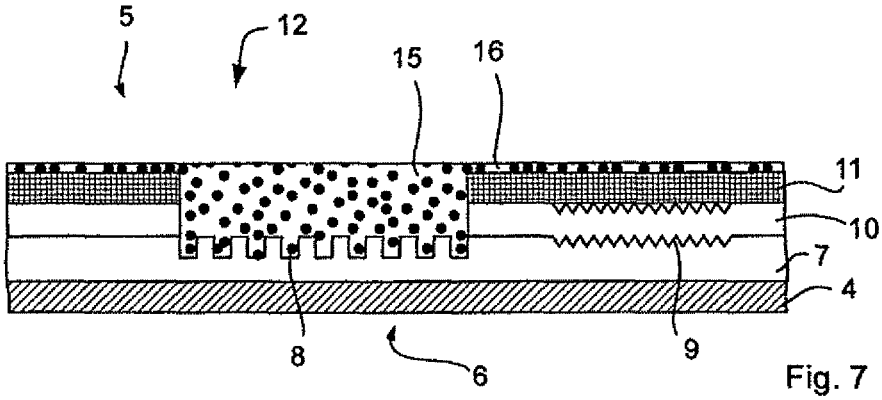
Figure 8:
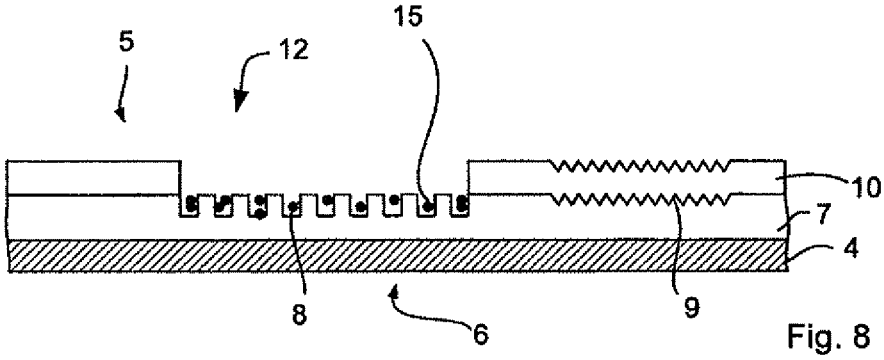

Regarding FIG. 7 it should be remarked that, as mentioned at the outset, the layer thicknesses are not true to scale. The volume with the remaining color layer 15 recognizable above the microstructure in FIG. 7 is strongly enlarged through the representation that is not true to scale. In fact the volume above the microstructure is negligible in comparison to the volume of the depressions of the microstructure.

Now in a next step the protective lacquer 11 is removed. Thereby automatically also the undesired toning layer 16 is lifted off, and the surface of the aluminum layer 10 is blank again.

In construction types working without the hologram structure 9 of course the aluminum layer 10 can be completely omitted, so that the protective lacquer 11 is applied directly on the embossed layer 7 (if applicable with the interposition of one or several suitable separating layers). The production method would then be concluded after the removal of the protective layer 11.

Figure 9:
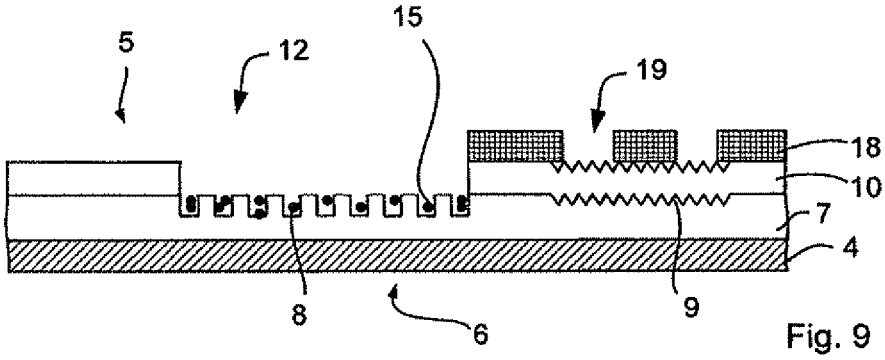
Figure 10:
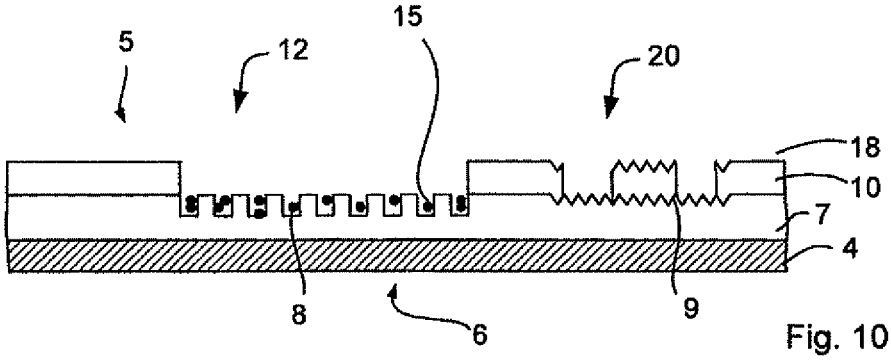

In the embodiment shown in the figures, however, in the embossing lacquer layer there is incorporated, together with the microstructure 8, also the hologram structure 9, and the aluminum layer 10 is put on top. To demetalize said layer in a suitably structured fashion so as to achieve the desired hologram effect, a second protective lacquer 18 is applied on top of the aluminum layer 10 at least in the area of the hologram structure 9 and structured as requested in such a fashion that windows 19 are created, at which the metalization, i.e. in the embodiment the aluminum layer 10 is to be removed again (FIG. 9). This removal of the aluminum layer 10 takes place e.g. through a suitable etching. After subsequent removal of the second protective layer 18 there is thus present a structured demetalization 20, as is needed for a properly effective hologram. As a result thus the section schematically represented in FIG. 10 is obtained, with a microstructure 8 whose depressions are equipped with a color layer 15, as well as a hologram structure 9 that is demetalized as requested.

In the first embodiment the protective layer 11 covers the upper side 5 by exception of the window 12, which contains the area with the microstructure elements 8 to be colored. There is no protective layer inside the microstructure elements 8.

The FIGS. 11 to 17 show an embodiment which applies a protective layer also on the elevations of the microstructure elements 8.

Figure 11:
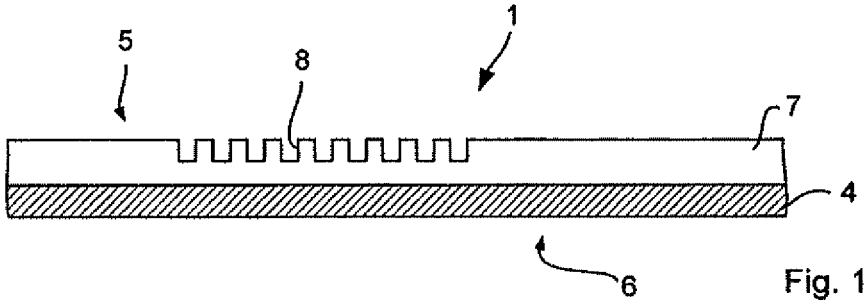
Figure 12:
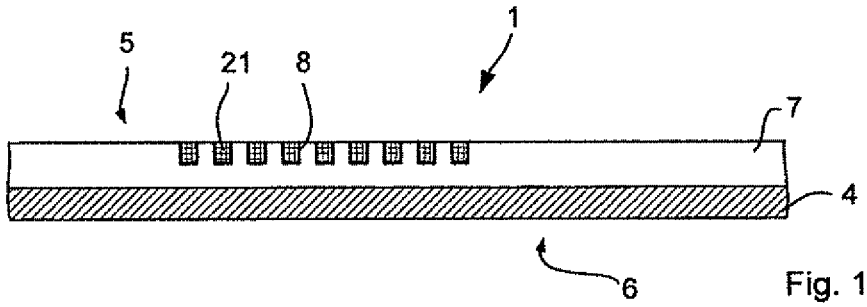
Figure 13:
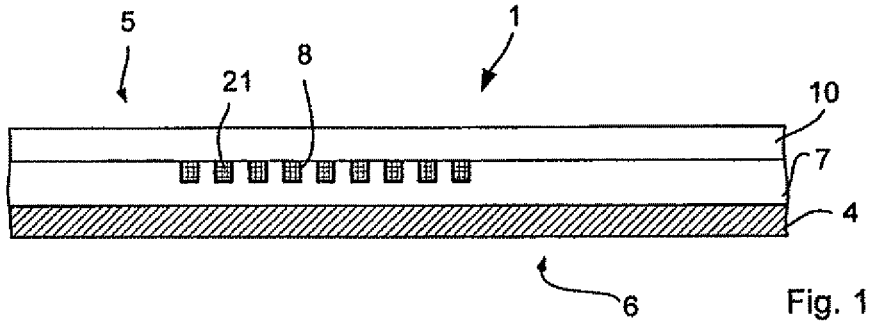

FIG. 11 corresponds in its representation to FIG. 2, thus showing a sectional view through the security element 1 of FIG. 1 at the start of its production according to the second embodiment. For production a carrier that can be configured for example as a foil 4, is equipped on its upper side 5 with an embossable layer 7 which, in the described embodiment, is an embossing lacquer layer, for example a UV-curable embossing lacquer. Of course the coating can also be provided on a lower side of the foil 4; however, for reasons of simplicity this description is limited to describing the layer structure on the upper side 5.

In the embossing lacquer layer microstructure elements 8 are molded, for example through a known embossing method, as mentioned in the already mentioned WO 2008/0311701 A1. As a result on the upper side 5 there is obtained an embossed layer 7 having microdepressions in the form of the microstructure elements 8.

Having thus reached the state represented in FIG. 11, a separating layer 21 is applied in the microdepressions of the microstructure elements 8. The separating layer can be a resist lacquer, as known from printing technology or semiconductor technology. Such a resist lacquer is usually applied over the complete surface first and then photographically structured by means of a suitable exposure, so that after development only the exposed (in the case of a positive lacquer) or unexposed (in the case of a negative lacquer) areas remain blank. Of course instead of a resist lacquer also a washing ink known to the person skilled in the art can be used. It is essential for the separating layer 21 that it can be removed again, also taking away coatings disposed above it in the process.

The modalities of the separating layer are not really relevant to the invention, as long as it is disposed exclusively in those depressions of the microstructure elements 8 that are to be colored. In case the microstructure is to be equipped with different colors one will not strive for the state represented in FIG. 12, but will equip only those microdepressions of the microstructure elements 8 with the separating layer 21 that are to be colored in the subsequent run. For the sake of simplicity the representation of FIG. 12 will assumes that all microdepressions of the microstructure elements 8 are to be colored.

Next a full-surface coating of the surface takes place, e.g. in that an aluminum layer 10 is applied, for example vapor-deposited. The coating with the protective layer takes place in such a fashion that the embossed layer 7 and in particular the microdepressions filled with the separating layer 21 are equipped with the protective layer, e.g. the aluminum layer 10. Instead of the aluminum layer 10 there can also be used another suitable protective layer which is detached as well upon the removal of the separating layer 21 from the microdepressions of the microstructure, but otherwise remains on the upper side 5.

Figure 14:
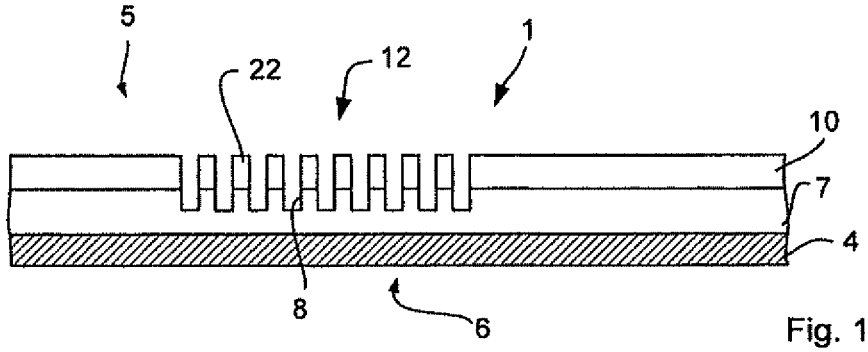

Then the separating layer 21 is removed again. The result of this removal step is represented in FIG. 14. As shown, the aluminum layer 10 remains only outside die microdepressions. In particular in the area of the microelevations of the microstructure an aluminum plating 22 is given, since the aluminum layer 10 was removed only in those places where it was disposed above the separating layer 21 through the removal of the latter.

Figure 15:
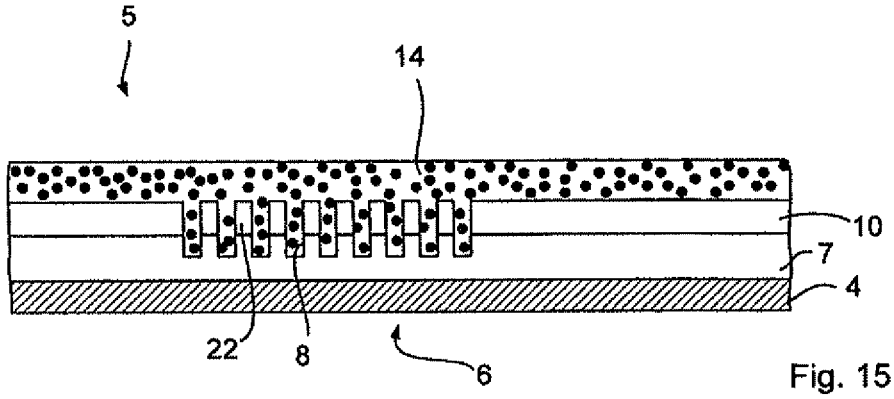

Subsequently, as shown by the sectional view of FIG. 15, a color layer 14 is applied over the full surface. This covers the complete upper side 5, thus both the structured areas with the microstructure and the aluminum plating 22 above the elevations of the microstructure and the structured areas of the aluminum layer 10.

Figure 16:
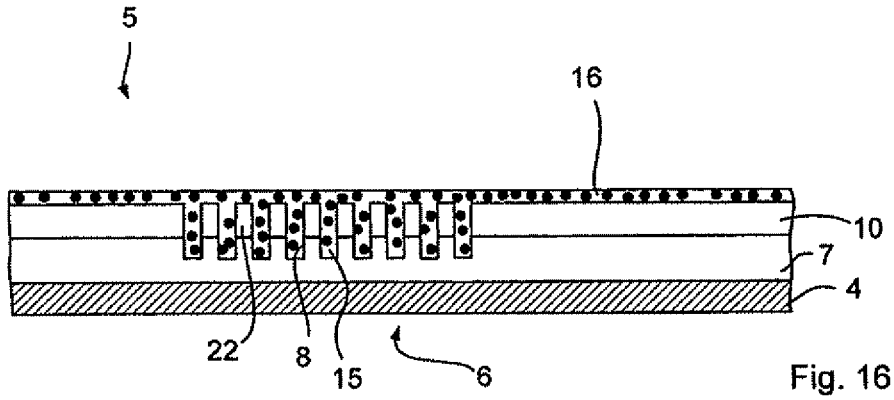

The color layer 14 is then removed as far as possible outside the microdepressions. This takes place for example by scraping off, so that the color layer 15 remains, however which as a rule inevitably has a toning layer 16 also in those areas of the surface 5 under which there are no microstructures. This state is shown in FIG. 16.

Now in a final step the aluminum layer 10 is removed. Thus it has the same function as the protective lacquer 11 of the first embodiment described above. With the removal of the aluminum layer 10 the undesired toning layer 16 is automatically also lifted off, and the surface of the embossed layer 7 remains blank, with the color layer 15 now being disposed exclusively in the microdepressions of the microstructure elements 8. The removal of the aluminum layer 10 takes place e.g. by a suitable etching.

Of course instead of the aluminum layer 10 also a different suitable coating can be used. It merely has to fulfill the requirement that, when the separating layer 21 is removed, the coating is detached only in these areas above the separating layer 21 and otherwise remains on the embossed layer 7.

For structuring the protective layer of course also other techniques come into question. Also the hologram structure that was described only in connection with FIGS. 2 to 10, can be produced also in the embodiment of FIGS. 11 to 17.

Figure 17:
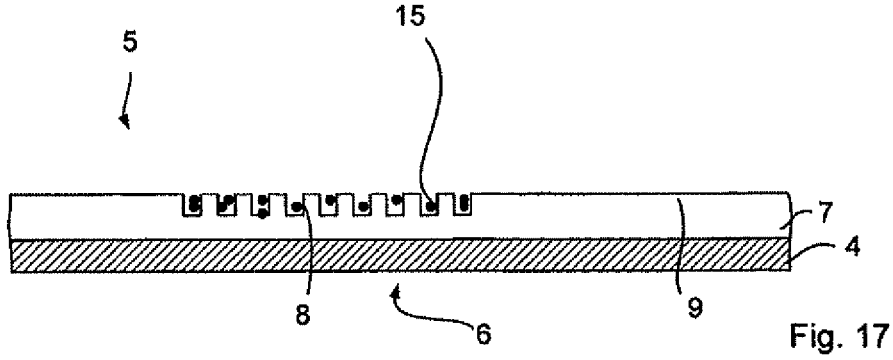

The further processing after FIG. 10 or 17 then takes place in the fashion usual in the field and for example comprises the application of the enlargement elements for a moiré-magnifier security element, the application of adhesive layers or primer print layers etc. This is known to the person skilled in the art.

LIST OF REFERENCE NUMBERS

1 security element
2 banknote
3 security thread
4 carrier
5 upper side
6 lower side
7 embossed layer
8 microstructure
9 hologram structure
10 aluminum layer
11 protective lacquer
12 window
14 color layer
15 color layer after scraping off
16 toning layer
17 colored microstructure
18 $2^{nd}$ protective lacquer
19 window
20 demetalization
21 separating layer
22 aluminum plating

The invention claimed is:

1. A method for producing a security element having microdepressions that are colored with a certain color comprising the following steps:

a) coating an upper side of a carrier with an embossable layer, b1) forming microdepressions in the embossable layer to configure an embossed layer, b2) applying a protective layer on the embossable layer, wherein the protective layer is structured so that it does not cover the microdepressions that are to be colored with the certain color, c) applying the certain color on the carrier upper side, in a manner such that the color remains in the microdepressions as a filling, d) removing the structured protective layer and thereby any color toning present outside the microdepressions, with the color filling being limited to the microdepressions.

2. The method according to claim 1, wherein step b2) a structured protective layer is applied that has a window in which the microdepressions are disposed.

3. The method according to claim 2, wherein before step b2) the coated upper side is metalized, in step b2) the structured protective layer is applied, with the protective layer being configured so that it protects the metalization from etching, and after applying the structured protective layer, the metalization that is not protected by the protective layer and is disposed in the window is etched so as to demetalize the microdepressions.

4. The method according to claim 3, wherein in step b1) or before step b2), hologram structures are also formed in the embossable layer, with the hologram structures being metalized and provided with the protective layer and, after step d), e) outside the hologram structures the upper side is provided with a protective coating and f) areas of the hologram structures that are not provided with the protective coating are demetalized by etching.

5. The method according to claim 1, wherein, in step b2), for applying the structured protective layer, first a separating layer is incorporated in the microdepressions, then the protective layer is applied and, through removal of the protective layer disposed in the microdepressions, the part of the protective layer which is disposed above the microdepressions is also detached and the protective layer is thereby structured.

6. The method according to claim 1, wherein the upper side or a lower side of the carrier is provided with an adhesive layer.

7. The method according to claim 1, wherein the upper side or a lower side of the carrier is provided with a primer print.

8. The method according to claim 1, wherein in step c), a kiss print is used to apply color.

9. The method according to claim 1, wherein, in step c) for color application on the upper side, color is applied over the surface and excess color is scraped off.

10. The method according to claim 1, wherein as the protective layer, a washing ink or a resist lacquer is used.

11. The method according to claim 1, wherein a separating layer is applied in the microdepressions in the embossable layer, the separating layer including a washing ink or a resist lacquer.

12. The method according to claim 1, wherein the steps b2) to d) are repeated with a further color that differs from the certain color, with the protective layer being structured differently in the steps (b2).

13. The method according to claim 1, wherein the microdepressions have a depth of between 1.5 and 3.5 μm.

14. A method for producing a security element, the method comprising the steps of:

forming an embossing layer on a first side of a carrier;

forming an area including a plurality of microstructure elements in the embossing layer;

forming a protective layer on the embossing layer, a window being formed in the protective layer such that the protective layer is not arranged over the area including the plurality of microstructure elements;

applying a color layer such that at least a portion of the color layer is formed on the area including the plurality of microstructure elements; and removing the protective layer and a portion of the color layer that is formed on the protective layer.

15. The method according to claim 14, wherein in the step of forming the protective layer, a structured protective layer is applied that has a window in which the plurality of microstructure elements are disposed.

16. The method according to claim 15, wherein before step of forming a protective layer on the embossing layer, a metal layer is formed on the embossing layer, a portion of the metal layer being protected by the protective layer once the protective layer is formed, and a portion of the metal layer that is not protected by the protective layer and is disposed in the window is removed by etching to demetalize the plurality of microstructure elements.

17. The method according to claim 16, wherein hologram structures are formed in the embossable layer, with the hologram structures being metalized and provided with the protective layer.

18. The method according to claim 17, wherein outside the hologram structures the embossing layer is provided with a protective coating, and areas of the hologram structures that are not provided with the protective coating are demetalized by etching.

19. The method according to claim 14, wherein, in the step of forming a protective layer on the embossing layer, first a separating layer is incorporated in the plurality of microstructure elements, then the protective layer is applied and, through removal of the protective layer disposed in the plurality of microstructure elements, the part of the protective layer which is disposed above the plurality of microstructure elements is also detached and the protective layer is thereby structured.

20. The method according to claim 14, wherein a separating layer is applied in plurality of microstructure elements in the embossable layer, the separating layer including a washing ink or a resist lacquer.

* * * * *